US005647624A

United States Patent [19]

Beshara, Jr.

[11] Patent Number: 5,647,624

[45] Date of Patent: Jul. 15, 1997

[54] ADHESIVE ADD-ON BOTTLE HANDLE

[76] Inventor: Anthony Beshara, Jr., 1725 Emmons Ave-F1, Brooklyn, N.Y. 11235

[21] Appl. No.: 686,117

[22] Filed: Jul. 23, 1996

[51] Int. Cl.[6] ..... B65D 23/10

[52] U.S. Cl. ..... 294/27.1; 220/752; 215/396

[58] Field of Search ..... 294/27.1, 31.2, 294/33; 220/738, 752, 757, 758, 762; 229/117.09, 117.19, 117.23, 89; 215/396

[56] References Cited

U.S. PATENT DOCUMENTS

| | | | |
|---|---|---|---|
| 1,999,878 | 4/1935 | Bombard | 294/31.2 |
| 2,248,234 | 7/1941 | Hickman et al. | 294/27.1 |
| 2,605,945 | 8/1952 | Dechar | 294/31.2 |
| 2,775,382 | 12/1956 | Kayat | 229/117.23 |
| 3,357,623 | 12/1967 | Wommelsdorf | 229/117.23 |
| 3,702,203 | 11/1972 | Oltmanns | 294/31.2 |
| 4,094,449 | 6/1978 | Schlegel | 294/31.2 |
| 4,230,235 | 10/1980 | Di Amico | 294/27.1 |
| 4,923,082 | 5/1990 | Bird | 294/31.2 |
| 5,259,653 | 11/1993 | Jacobsen | 294/33 |

FOREIGN PATENT DOCUMENTS

| | | | |
|---|---|---|---|
| 94/08856 | 4/1994 | WIPO | 229/117.19 |

*Primary Examiner*—Dean Kramer
*Attorney, Agent, or Firm*—Goldstein & Associates

[57] ABSTRACT

An adhesive bottle handle comprising a flat base and two grips that rise out of the base. The flat base is coated with adhesive on one side for attachment to a bottle. The two grips can be raised out of the base for usage or lowered back into the base for storage or shipping purposes.

11 Claims, 4 Drawing Sheets

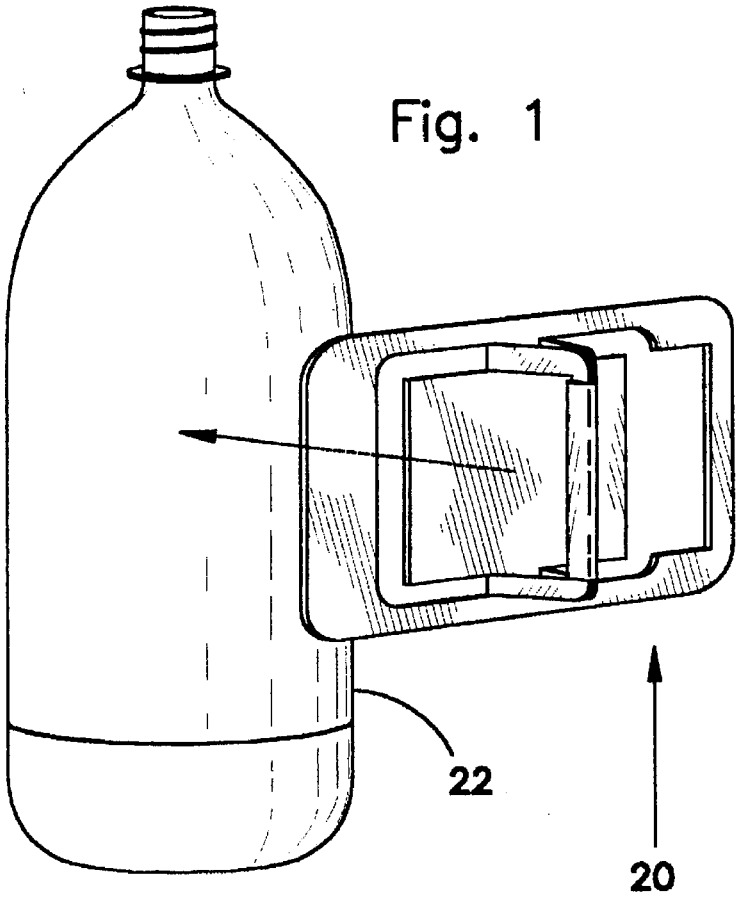
Fig. 1
Fig. 2
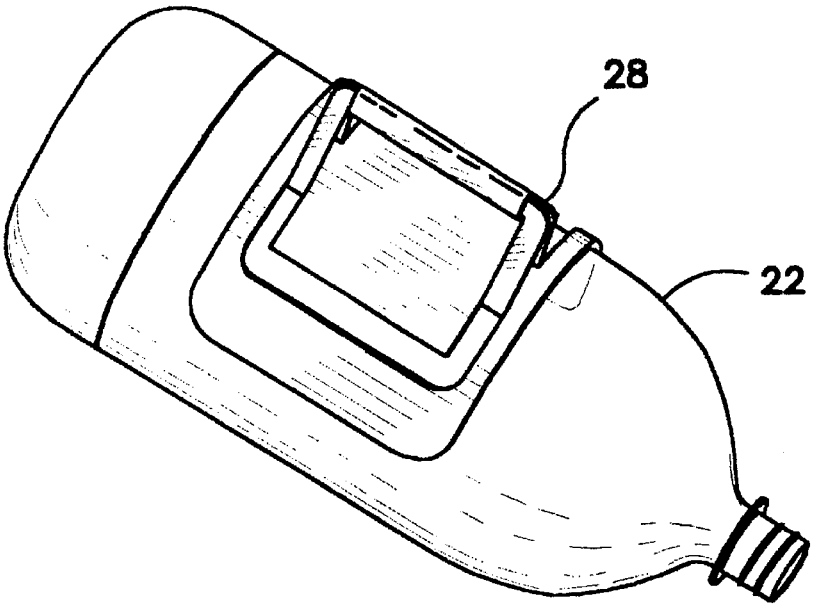

ADHESIVE ADD-ON BOTTLE HANDLE

BACKGROUND OF THE INVENTION

The invention relates to an adhesive bottle handle. More particularly, the invention relates to a device which attaches to a handle-less bottle and then provides a grip for allowing one handed management of the bottle.

Pouring a container with one hand is possible if either the container is narrow enough to be held with one hand, or if it has its own handle. However, many containers commonly used in the sale of consumer products are too large to be grasped by the hand of an average adult. They are even more difficult to grasp by a child, thus leading to frequent spills and other mishaps.

The most common bottle in which soft drinks are sold in the United States is the two-liter bottle. The two-liter bottle has a familiar tall and thin appearance. However, the two-liter bottle is almost impossible to pour with one hand. Thus, a person pouring a soft drink from a two-liter bottle will usually ask another person to hold the cup into which the liquid is being poured, during the pouring operation. However, if no one is available to hold the cup, the pourer risks knocking the cup over with the force of the liquid being poured.

Other containers, such as the familiar ½ gallon milk carton, are similarly difficult to manage. One usually partially braces the container against their body to pour the container using one hand.

Others have attempted to deal with this problem by providing add-on handles having various configurations. These attempts tend to be impractical, and limited in use.

In particular, U.S. Pat. No. 5,259,653 to Jacobsen discloses a carrier handle mountable on a top folded carton unit. This invention comprises a handle portion, two bendable plate arm members and a rigid upper portion that is inserted into the folded section of the carton. While this invention is practical for containers having a folded top portion and four sides, it is limited in its use to such containers. It cannot be employed on round bottles or containers not having a folded top portion.

Another such invention that is limited in its use is U.S. Pat. No. 5,183,169 to Grzych, disclosing a reusable handle. The invention comprises a handle running the length of the bottle body, an arm with a gripping portion and a bottle neck ring, and a jacket attaching to the bottom of the bottle. Because of the cylindrical shape of the bottom jacket, this invention is limited in use to containers having a round body.

While these units may be suitable for the particular purpose employed, or for general use, they would not be as suitable for the purposes of the present invention as disclosed hereafter.

SUMMARY OF THE INVENTION

It is a primary object of the invention to provide a handle which allows effective one-handed management of these containers.

It is also an object of the invention to produce an adhesive bottle handle that can be used on bottles of various shapes and sizes, including standard two liter bottles. The handle has as flexible flat base which may be attached to any shape bottle.

It is another object of the invention to produce an adhesive bottle handle that can easily be attached to a bottle immediately after the manufacture of said bottle without dramatically altering the size or appearance of the bottle. The bottle could then be shipped in the usual manner, with the handle attached, with no added difficulties or expense. Before use by the ultimate consumer, the grips can be unfolded perpendicular from its flat base, secured to one another, and then used as a handle for the bottle.

It is a further object of the invention to produce an adhesive bottle handle that provides a user with a handle for handle-less bottles to provide easy maneuvering of said bottles.

The invention is an adhesive bottle handle comprising a flat base and two grips that rise out of the base. The flat base is coated with adhesive on one side for attachment to a bottle. The two grips can be raised out of the base for usage or lowered back into the base for storage or shipping purposes.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is a diagrammatic perspective view of the invention about to be attached onto a conventional two liter handle, the grips are illustrated in the operable position for illustrative purposes only.

FIG. 2 is a diagrammatic perspective view of the invention, illustrating the handle device already affixed to a bottle, and ready to use.

DETAILED DESCRIPTION OF THE PREFERRED EMBODIMENTS

FIG. 1 illustrates an add-on handle device 20, about to be attached onto a bottle 22.

Figure 3:
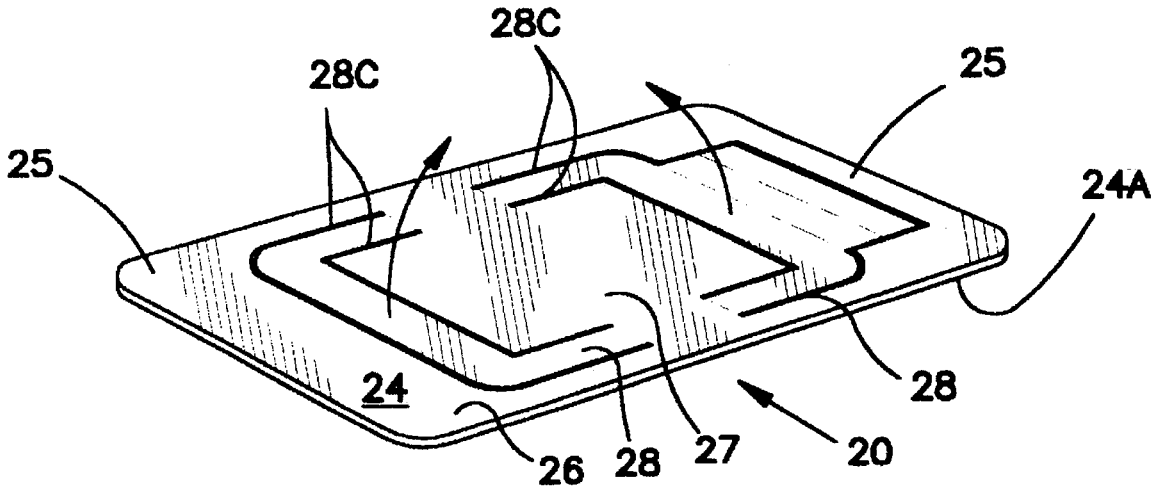
FIG. 3 is a diagrammatic perspective view of the invention in its storage position, wherein all components extend in substantially the same plane.

Referring to FIG. 3, the handle device 20 is shown in its storage position, in which all components extend in the same plane, known as a base plane 24. The handle device 20 comprises a base 26 and a pair of grips 28. The handle device 20 is comprised of a single sheet of flexible material out of which the grips 28 are cut or stamped. Preferable materials for the handle 20 are paper and plastic.

The grips 28 are defined by grip cuts 28C. Two substantially parallel "U" shaped grip cuts 28C define each handle. The grip cuts 28C are arranged so that the grips 28 are symmetrical to each other, but do not directly border each other when in the storage position.

The base 26 includes outer portions 25 which surround the grips 28 in the base plane 24, and a central portion 27 which defines an area between the grips 28 in the base plane 24, and thus separates the grips 28. Because the grip cuts 28C for one handle do not touch the grip cuts 28C for the other handle, the central portion 27 remains attached to the outer portions 25.

Adhesive is present on a rear plane 24A, which is a back surface of the base plane 24A. The adhesive allows the rear plane 24A to secure onto the bottle 22. A strong adhesive is used at the outer portion 25 and central portion 27. A light adhesive may also be used on the grips on the rear plane 24A, to keep the grips 28 flat against the bottle 22 during storage. The light adhesive allows the grips 28 to be easily peeled from the bottle when desired. In contrast, the strong adhesive creates a permanent, powerful bond between the base 26 and the bottle 22, so that the base 26 cannot be removed from the bottle 22 once applied. The adhesive used as the strong adhesive is of similar strength to adhesives used in self adhesive wall hangings.

Figure 4:
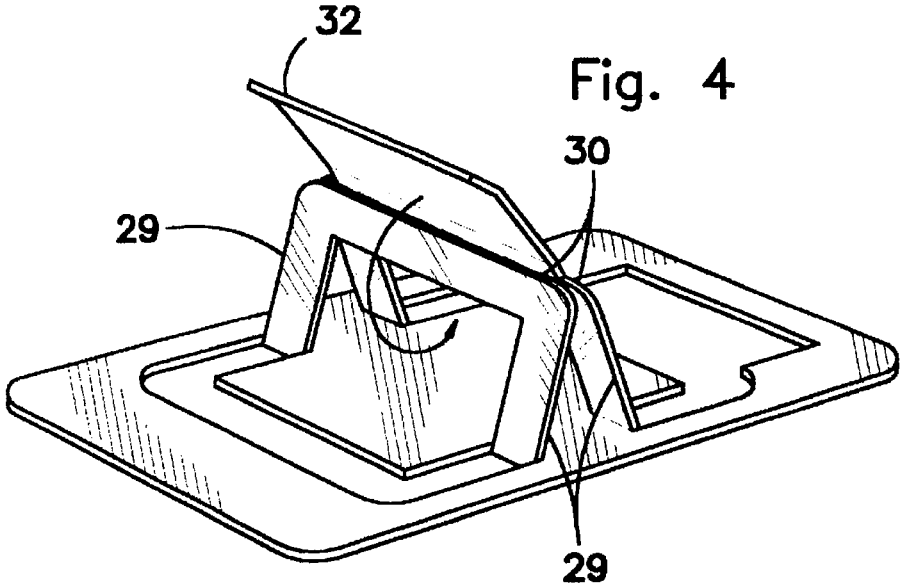
FIG. 4 is a diagrammatic perspective view of the invention being placed into its operable position, wherein the grip portions have been folded nearly perpendicular from the base plane, and wherein a securing flap is about to be folded around both grip portions.

Referring to FIG. 4, the grips have been folded into the operable position, where they extend nearly perpendicular to the base plane 24. The grips 28 each have two legs 29 which extend from the base plane, and extend nearly perpendicular to the base plane 24 when in the operable position. The grips 28 also have a transverse portion 30 which connects the two legs, and extends substantially parallel to the base plane 24.

Figure 5:
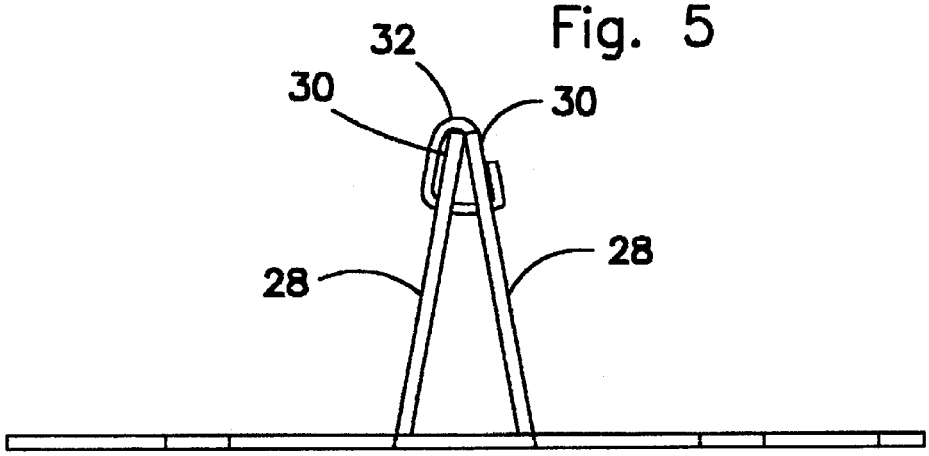
FIG. 5 is a side elevational view of the invention in its operable position with the grips attached to one another.

In FIG. 4, a securing mechanism comprises a securing flap 32 that extends from the transverse portion 30 of one of the grips 28. Referring to FIG. 5, the securing flap 32 extends from the transverse portion 30 of one of the grips 28, wraps around the transverse portion 30 of the other grip 28, and then attaches to the transverse portion 30 of the grip 28 from which it extends.

Once again, illustrated in FIG. 1, the handle device 20 is about to be attached onto the bottle 22. As illustrated, the handle device 20 has been placed in the operable position before application to the bottle 22. However, generally the handle device 20 will be applied to the bottle in its flat, storage position. In the storage position, the handle device 20 does not substantially increase the diameter of the bottle, and thus may be packaged, shipped, and stored using the same materials as would be used to package, ship, and store the bottles if they did not have the handle device 20 adhered thereto.

Once the bottle reaches the ultimate consumer of its contents, the handle may be placed into the operable position by folding up the grips 28 and securing the grips 28 to each other, as shown in FIG. 2. The bottle 22 is then ready to be poured.

Figure 6:
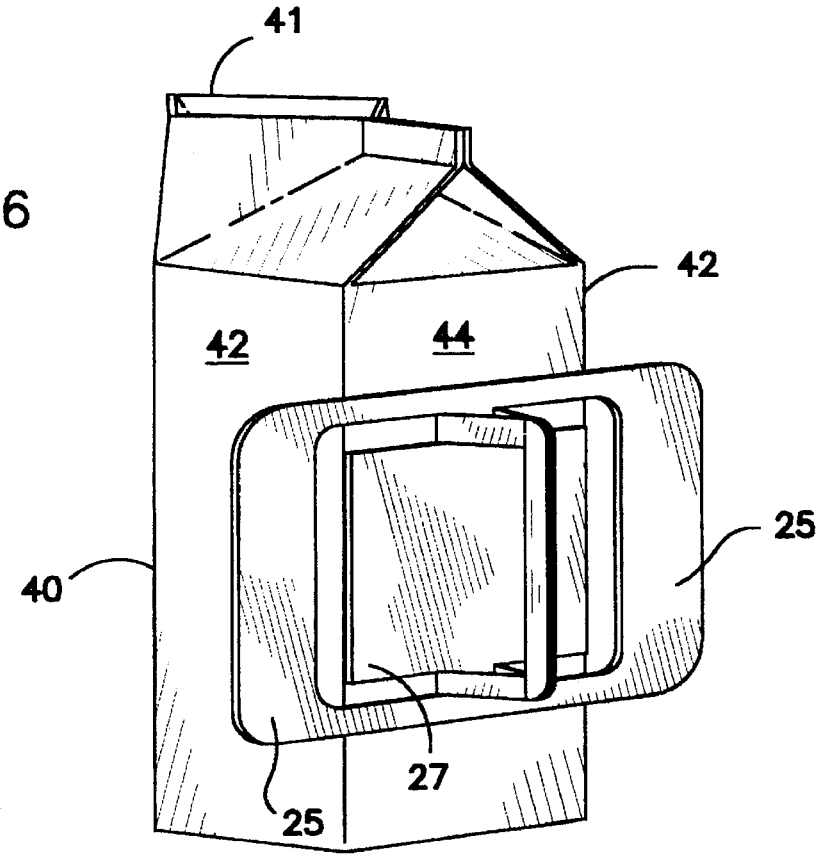
FIG. 6 is a diagrammatic perspective view of the invention about to be applied to a rectangular carton type container.

FIG. 6 illustrates how the handle device 20 can be used on a non-round bottle, such as a common folded-top milk carton 40, having a spout 41, a back surface opposite the spout 41, and two side surfaces 42 extending from the back surface 44 parallel to each other. Here, the central portion 27 of the base 26 adheres to the back surface 42 of the carton 40. The outer portions 25 wrap around the side surfaces 44 for added strength. In general, it can be seen that the handle device may be adhered on bottles having a variety of shapes.

Figure 7:
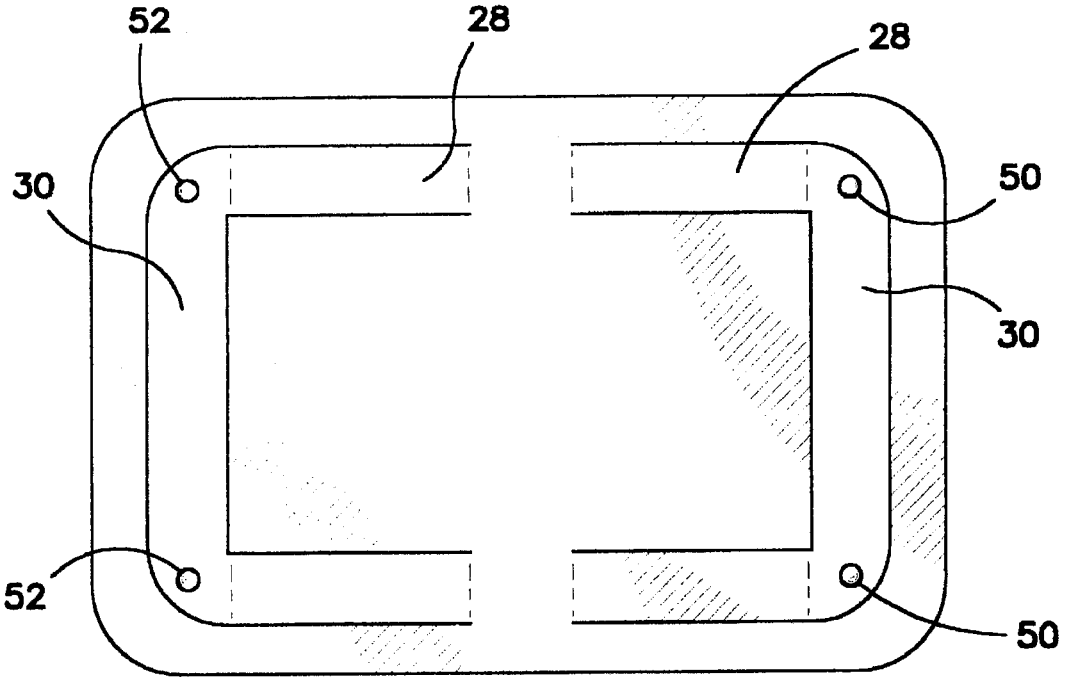
FIG. 7 is a top plan view of another embodiment of the invention, have a dimple and pimple securing mechanism.

FIG. 7 illustrates a further embodiment, in which the securing mechanism comprises a pair of pimples 50 on the transverse portion 30 of one of the grips 28, and a pair of dimples 52 on the transverse portion 30 of the other grip 28.

Figure 8:
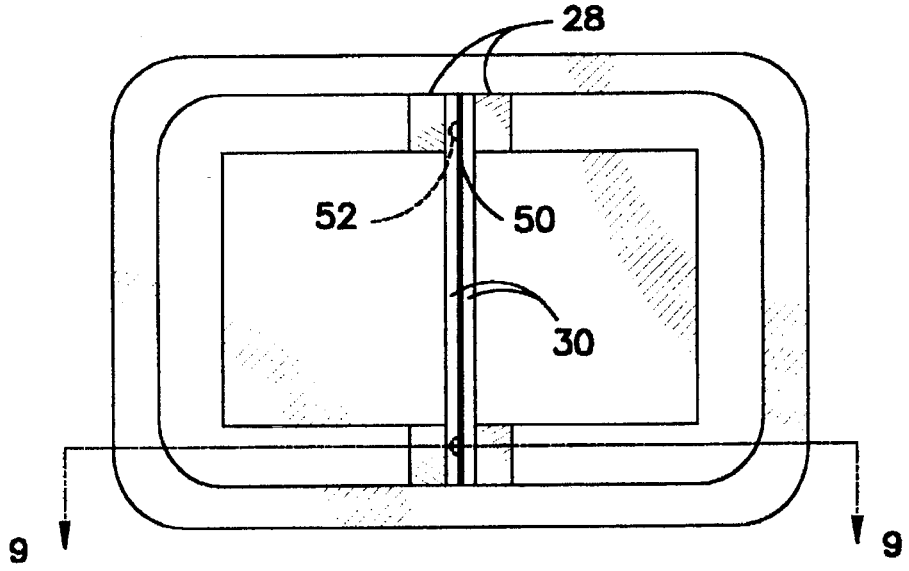
FIG. 8 is a top plan view of the invention illustrated in FIG. 7 in the operable position, with the dimple and pimple mated.

As illustrated in FIG. 8, the grips 28 are secured to one another by simply bringing the transverse portions 30 together, thus mating the pimples 50 and dimples 52.

Figure 9:
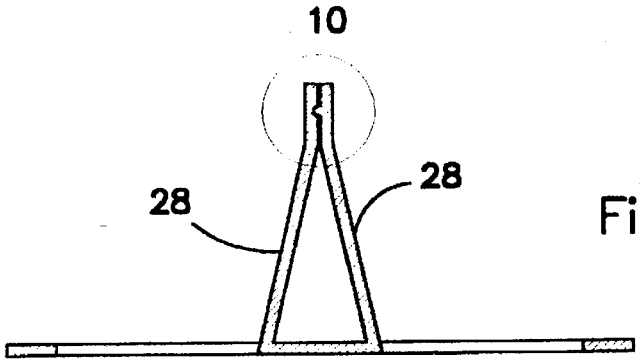
FIG. 9 is a cross sectional view, taken along line 9—9 in FIG. 8.
Figure 10:
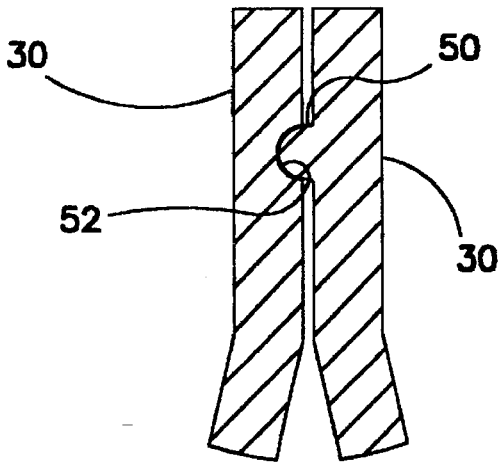
FIG. 10 is an enlarged cross sectional view, taken in the area of circle 10 in FIG. 9.

FIG. 9 is a cross sectional view illustrating the mated pimple 50 and dimple 52 securing the grips 28 together. FIG. 10 is a further enlarged view, taken in the area of circle 10 in FIG. 9, illustrating how the mated pimple 50 and dimple 52 allow the transverse portions 30 to extend nearly parallel to each other.

In conclusion, herein is presented an add-on handle device which may be attached onto a bottle to provide a pair of grips. The grips may be stored flat against the bottle, or may be extended perpendicular to the bottle and secured to each other, to provide for easier handling of the bottle.

What is claimed is:

1. A handle for attaching to a bottle, comprising:

a base, the base planar and substantially thin, adhesive present on the base for affixing the base to the bottle;

a pair of grips, each grip having a transverse portion, the grips capable of being in a storage position and an operable position, in the storage position the grips extend in the same plane as the base, in the operable position the grips extend substantially perpendicular to the base with the transverse portions touching each other, the base having outer portions surrounding the grips in the base plane, the adhesive is present on the outer portions; and a securing mechanism, for securing the transverse portions of the grips to each other when in the operable position.

2. The handle as recited in claim 1, wherein the handle is comprised of a single planar sheet of a material, and further comprises grip cuts which define the grips, the grips are foldable perpendicular to the rest of the planar sheet which then comprises the base.

3. The handle as recited in claim 2, further comprising a rear plane, and wherein the adhesive is present on the rear plane.

4. The handle as recited in claim 3, wherein the securing mechanism further comprises a securing flap extending from the grip opposite the base.

5. The handle as recited in claim 3, wherein the securing mechanism further comprises at least one pimple on one of the grips, and at least one dimple on the other grip, the pimple mating with the dimple to secure the two grips to each other.

6. The handle as recited in claim 5, wherein the base further comprises a central portion between the handles in the base plane.

7. The handle as recited in claim 6, wherein a strong adhesive is present on the central and outer portions of the base, and a light adhesive is present on the rear plane of the grips.

8. A method of manufacturing a bottle with a handle, for delivering a liquid to an ultimate consumer, comprising:

forming a bottle;

forming a handle device having two grips from a single, flat piece of material, said handle device having an outer portion which surrounds the two grips;

affixing the handle device to the bottle by adhering the outer portion to the bottle, the handle device conforming to the shape of the bottle;

transporting the bottle to the ultimate consumer of the liquid; and extending the grips substantially perpendicular to the bottle by unfolding the grips from the handle device.

9. The method of manufacturing a bottle with a handle as recited in claim 8, further comprising the step of:

securing the extended grips to one another.

10. The method of manufacturing a bottle with a handle as recited in claim 9, wherein one of the grips further has a securing flap, and wherein the step of securing the extended grips to one another further comprises:

wrapping the securing flap around both grips.

11. The method of manufacturing a bottle with a handle as recited in claim 9, wherein one of the grips has a pimple and the other grip has a dimple, and the step of securing the extended grips to one another further comprises:

mating the pimple with the dimple.

* * * * *